US008186070B2

(12) United States Patent
Theurer et al.

(10) Patent No.: US 8,186,070 B2
(45) Date of Patent: May 29, 2012

(54) METHOD AND MACHINE FOR LOWERING A TRACK

(75) Inventors: Josef Theurer, Vienna (AT); Bernhard Lichtberger, Pregarten (AT)

(73) Assignee: Franz Plasser Bahnbaumaschinen-Industriegesellschaft M.B.H., Vienna (AT)

( * ) Notice: Subject to any disclaimer, the term of this patent is extended or adjusted under 35 U.S.C. 154(b) by 420 days.

(21) Appl. No.: 12/575,983

(22) Filed: Oct. 8, 2009

(65) Prior Publication Data

US 2010/0018432 A1 Jan. 28, 2010

Related U.S. Application Data

(63) Continuation of application No. PCT/EP2008/001698, filed on Mar. 4, 2008.

(30) Foreign Application Priority Data

Apr. 12, 2007 (AT) ..... A 563/2007

(51) Int. Cl.
*E01B 29/04* (2006.01)

(52) U.S. Cl. ..... 33/338; 33/1 Q; 33/651

(58) Field of Classification Search ..... 33/338, 33/1 Q, 651; 104/2, 7.1, 8, 10, 12
See application file for complete search history.

(56) References Cited

U.S. PATENT DOCUMENTS 4,046,079 A * 9/1977 Theurer ..... 104/7.2
4,490,038 A * 12/1984 Theurer et al. ..... 356/4.01
4,827,848 A * 5/1989 Kusel ..... 104/3
5,007,349 A * 4/1991 Theurer ..... 104/12
5,025,566 A * 6/1991 Fiechter ..... 33/338
5,094,004 A * 3/1992 Wooten ..... 33/338
5,172,637 A * 12/1992 Theurer et al. ..... 104/7.2
5,257,579 A * 11/1993 Theurer ..... 104/2
5,357,867 A * 10/1994 Theurer et al. ..... 104/2
5,456,180 A * 10/1995 Theurer et al. ..... 104/2
RE35,788 E * 5/1998 Theurer et al. ..... 37/104
6,154,973 A * 12/2000 Theurer et al. ..... 33/651
6,158,352 A * 12/2000 Theurer et al. ..... 33/287
6,415,522 B1 * 7/2002 Ganz ..... 33/523.1
6,415,720 B2 * 7/2002 Theurer et al. ..... 104/7.3

(Continued)

FOREIGN PATENT DOCUMENTS

DE 2434073 A1 1/1976

(Continued)

OTHER PUBLICATIONS

International Search Report dated Jun. 12, 2008.

*Primary Examiner* — Yaritza Guadalupe-McCall
(74) *Attorney, Agent, or Firm* — Laurence A. Greenberg; Werner H. Stemer; Ralph E. Locher

(57) ABSTRACT

For the controlled lowering of a track, a longitudinal inclination of the track is determined at a rear tracing point of a measuring system and stored. For a length reaching back at least 10 meters, a current vertical profile is formed, and a rear compensation straight line is calculated which is superimposed upon the vertical profile and renders a target track position. The rear tracing point is guided by calculation along the rear compensation straight line, so that a compensation value for the position of the measuring chord ensues at a middle tracing point positioned between the rear tracing point and a front tracing point.

8 Claims, 2 Drawing Sheets

U.S. PATENT DOCUMENTS

| | | | | |
|---|---|---|---|---|
| 6,422,150 | B2 * | 7/2002 | Theurer et al. | 104/2 |
| 6,450,101 | B2 * | 9/2002 | Theurer et al. | 104/2 |
| 6,474,241 | B2 * | 11/2002 | Theurer et al. | 104/9 |
| 6,477,960 | B2 * | 11/2002 | Theurer et al. | 104/9 |
| 7,181,851 | B2 * | 2/2007 | Theurer et al. | 33/1 Q |
| 7,370,586 | B2 * | 5/2008 | McHale et al. | 104/2 |
| 7,516,702 | B2 * | 4/2009 | Theurer et al. | 104/2 |
| 2001/0050023 | A1 * | 12/2001 | Theurer et al. | 104/2 |
| 2004/0045472 | A1 * | 3/2004 | Therurer et al. | 104/2 |
| 2005/0279239 | A1 * | 12/2005 | McHale et al. | 104/2 |
| 2009/0301340 | A1 * | 12/2009 | Valero Sin | 104/2 |
| 2010/0018432 | A1 * | 1/2010 | Theurer et al. | 104/2 |
| 2010/0116166 | A1 * | 5/2010 | Aguirre Fernandez | 104/2 |
| 2011/0274232 | A1 * | 11/2011 | Doll | 376/260 |

FOREIGN PATENT DOCUMENTS

| | | | |
|---|---|---|---|
| DE | 4102872 | A1 | 8/1991 |
| GB | 2268021 | A | 12/1993 |
| GB | 2268529 | A | 1/1994 |

* cited by examiner

FIG. 1
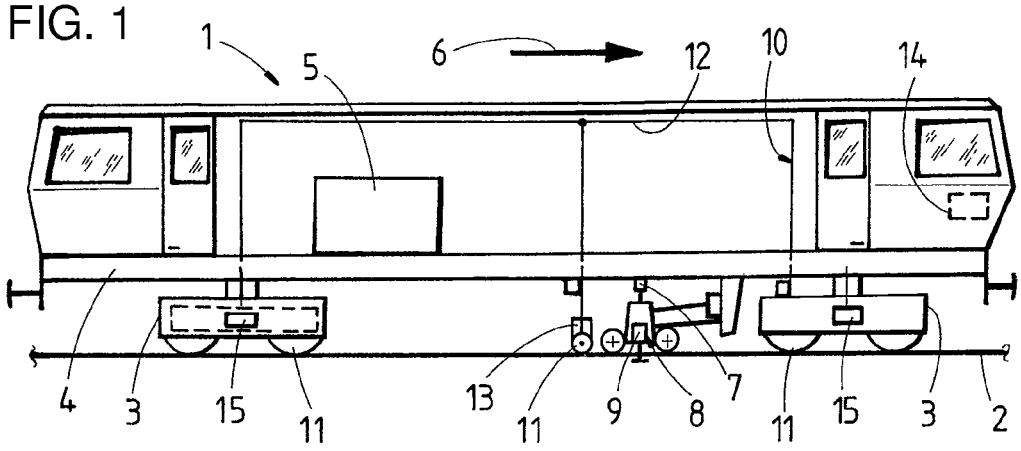
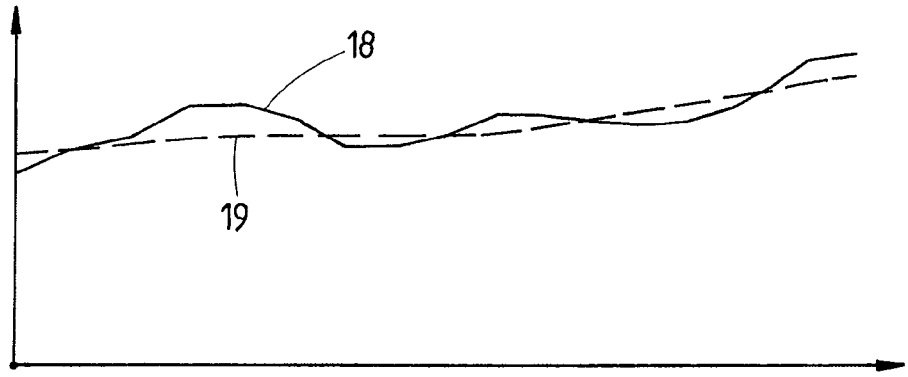
FIG. 3
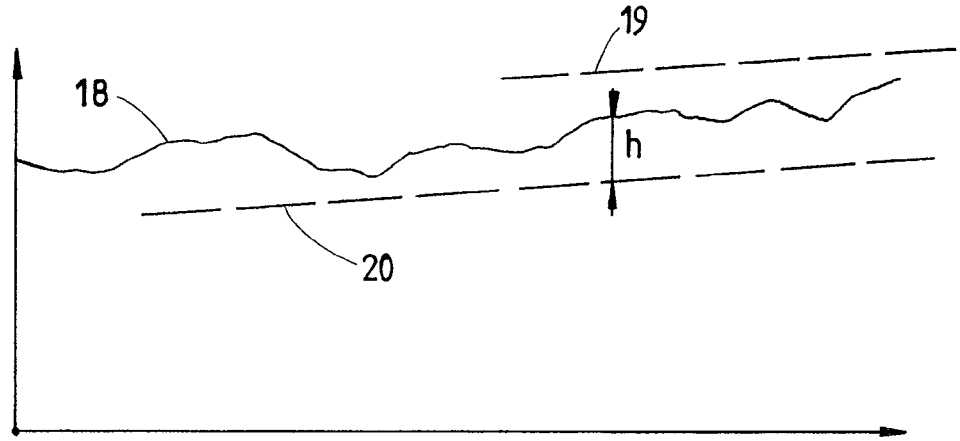
FIG. 4

METHOD AND MACHINE FOR LOWERING A TRACK

CROSS-REFERENCE TO RELATED APPLICATION

This application is a continuation, under 35 U.S.C. §120, of copending international application PCT/EP2008/001698, filed Mar. 4, 2008, which designated the United States; this application also claims the priority, under 35 U.S.C. §119, of Austrian patent application No. A 563/2007, filed Apr. 12, 2007; the prior applications are herewith incorporated by reference in their entirety.

BACKGROUND OF THE INVENTION

Field of the Invention

The invention relates to a method and a machine for the controlled lowering of a track. In the method, the track is set in transverse vibrations with the aid of dynamic striking forces and loaded with a vertical static load, wherein a settlement defining the lowering of the track is controlled by a measuring system, tracing the track position, which has a measuring chord extending in the longitudinal direction of the machine and comprising tracing points designed to roll on the track. The machine for the controlled lowering of the track has a stabilizing unit, arranged between on-track undercarriages designed to be form-fittingly applied to the track and producing dynamic striking forces, and a measuring system for detecting a longitudinal inclination of the track, the measuring system comprising a front tracing point and rear tracing point, with regard to a working direction, each designed to roll on the track, a middle tracing point positioned between the former, and an odometer.

A machine of this type, called a track stabilizer, is known from U.S. Pat. No. 5,172,637. There, the measuring system comprises three measuring axles designed to roll on the track, with each of which is associated a respective transverse pendulum for detecting the transverse inclination of the track. In this way, it is possible to precisely copy the transverse track inclination that was present prior to operation of the machine, so that the inclination is unchanged after operation of the machine.

According to British patent publications GB 2 268 021 or GB 2 268 529, it is known, in connection with a cleaning of the ballast, to arrange two longitudinal pendulums on a respective on-track undercarriage in order to detect the actual position of the track prior to the removal of the ballast and to reproduce the position after the introduction of the new ballast.

SUMMARY OF THE INVENTION

It is accordingly an object of the invention to provide a method and a machine for lowering a track which overcomes the above-mentioned disadvantages of the heretofore-known devices and methods of this general type and which allows the track position after the lowering of the track to be improved.

With the foregoing and other objects in view there is provided, in accordance with the invention, a method for the controlled lowering of a track, which comprises the following method steps:

setting the track in transverse vibrations with the aid of dynamic striking forces and loading the track with a vertical static load, and controlling a settlement defining the lowering of the track with a measuring system for tracing a track position, the measuring system having a measuring chord extending in a longitudinal direction of the machine and having tracing points configured to roll on the track and including a rear tracing point and a front tracing point, with reference to a working direction;

detecting and storing a longitudinal inclination of the track at the rear tracing point in connection with a distance measurement;

from the stored values for the longitudinal inclination and the distance measurement, forming a current vertical profile of the track for a length of track reaching back at least 10 meters from the rear tracing point with regard to the working direction, and calculating a rear compensation straight line that is superimposed upon the vertical profile and renders a target track position;

guiding the rear tracing point by calculation along the rear compensation straight line so that a compensation value for the position of the measuring chord ensues at a middle tracing point positioned between the rear tracing point and the front tracing point.

The particular problem posed by residual faults which are present after the use of the stabilizing unit lies in the fact that, in the course of operation of the machine, these faults can lead to an ever growing negative influence upon the rear tracing point. With the method according to the invention, it is now possible to guide the rear tracing point of the measuring system along a virtual compensation straight line. With this, it can be reliably precluded that the precision of the measuring system is compromised by remaining residual faults in connection with the lowering of the track with the aid of the stabilizing unit.

In accordance with an added feature of the invention, the method further comprises the following steps:

detecting and storing a longitudinal inclination of the track at the front tracing point in connection with a distance measurement;

from the stored values for the longitudinal inclination and the distance measurement, forming a current vertical profile of the track for a length of track reaching back at least 10 meters from the front tracing point with regard to the working direction, and calculating a front compensation straight line that is superimposed upon the vertical profile and renders a target track position; and guiding the front tracing point by calculation along the front compensation straight line so that a corresponding compensation value for the position of the measuring chord ensues at the middle tracing point.

In accordance with an additional feature of the invention, the method comprises using a difference, determined at the middle tracing point, between the actual position and the target position of the track, as a control variable for altering the dynamic striking force.

With the above and other objects in view there is also provided, in accordance with the invention, a machine for the controlled lowering of a track, comprising:

a stabilizing unit disposed between on-track undercarriages and configured to be form-fittingly applied to the track and producing dynamic striking forces;

a measuring system for detecting a longitudinal inclination of the track, the measuring system including a front tracing point and rear tracing point, with regard to a working direction, each designed to roll on the track, a middle tracing point positioned between the front and rear tracing points, and an odometer;

a longitudinal pendulum for detecting the longitudinal inclination of the track disposed on a rear on-track undercarriage, relative to the stabilizing unit;

a control device configured to store the longitudinal inclination and to form a current vertical profile and configured to determine, by calculation, a rear compensation straight line that is superimposed upon a current vertical profile and renders a target position.

In accordance with yet an added feature of the invention, there is provided, on a front on-track undercarriage (i.e., with respect to the stabilizing unit), a longitudinal pendulum for detecting the longitudinal inclination of the track; also, a control device is provided for storing the longitudinal inclination and forming a current vertical profile; the control device calculates a front compensation straight line that is superimposed upon the current vertical profile and renders a target position.

In accordance with yet an additional feature of the invention, the pendulums are provided as two longitudinal pendulums, spaced from one another in a transverse direction of the track, on each of the on-track undercarriages.

In accordance with a concomitant feature of the invention, a distance between the middle tracing point and the front tracing point of the measuring system is smaller than a distance between the middle tracing point and the rear tracing point.

These embodiments require merely small additional structural expense without any need to change the measuring system itself.

Other features which are considered as characteristic for the invention are set forth in the appended claims.

Although the invention is illustrated and described herein as embodied in a method and machine for the lowering of a track, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 1 is a schematic side view of a track stabilizer having a measuring system for a controlled lowering of a track;

FIGS. 3, 4 are further schematic representations, respectively, of the vertical profile of the track.

DETAILED DESCRIPTION OF THE INVENTION

Figure 2:
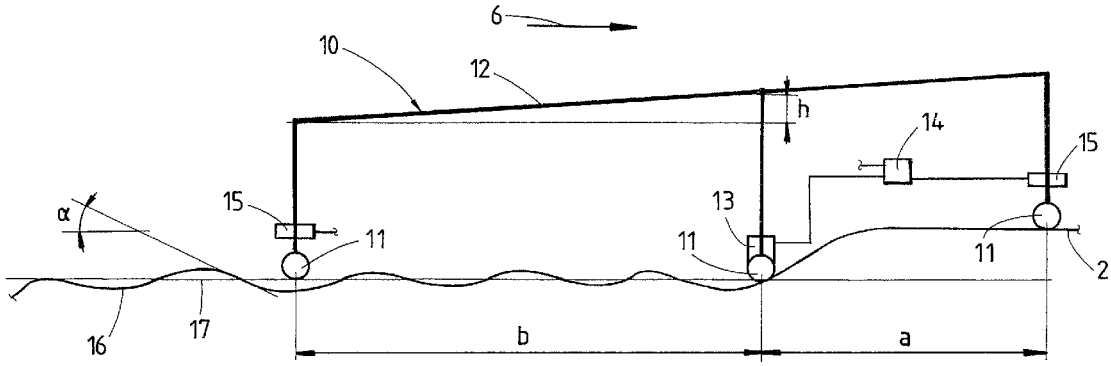
FIG. 2 is a schematic representation of the measuring system.

Referring now to the figures of the drawing in detail and first, particularly, to FIG. 1 thereof, there is shown a machine 1 for the controlled lowering of a track 2. The machine is also referred to as a track stabilizer. The machine 1 comprises a machine frame 4 supported on on-track undercarriages 3 and is mobile in a working direction 6 with the aid of a motor 5.

Located between the on-track undercarriages 3 is a stabilizing unit 8 which is vertically adjustable by means of drives 7 and has a vibration drive 9. The latter produces transverse vibrations, acting upon the track 2 horizontally and perpendicularly to the longitudinal direction, which, in connection with a vertical static load by the two drives 7, cause a lowering of the track.

A measuring system 10 comprises—with respect to the working direction 6—a front tracing point 11, a rear tracing point 11 and a middle tracing point 11, the latter being positioned between the two former, each designed to roll on the track 2 for tracing the vertical track position. Two measuring chords 12 extending in the longitudinal direction of the machine are stretched between the front and rear tracing points 11, with the vertical position of the measuring chords 12 with respect to the track 2 being traced at the middle tracing point 11.

Arranged on each on-track undercarriage 3 are two longitudinal pendulums 15 spaced from one another perpendicularly to the longitudinal direction of the machine. Each longitudinal pendulum 15 serves for measuring a longitudinal inclination of the track 2. For detecting the distance traveled, an odometer 13 is provided on the middle tracing point 11. A control device 14 serves for storing and processing the measuring data determined by the measuring system 10.

The measuring system 10 is depicted schematically in FIG. 2. The front tracing point 11 is guided on a preliminary track position corrected by a tamping machine. By means of the middle tracing point 11 positioned in the region of the stabilizing unit 8, a lowering of the track 2 in the extent of a prescribed settlement h relative to the measuring chord 12 is detected. The rear tracing point 11 is guided along the final track position.

On the—with regard to the stabilizing unit 8 (see FIG. 1) or the middle tracing point 11—the rear longitudinal pendulum 15 is provided for detecting the longitudinal inclination $\alpha$ of the track 2. The control device 14 is designed for storing the longitudinal inclination $\alpha$ and for forming a current vertical profile 16 and for determining, by calculation, a compensation straight line 17 which is superimposed on the vertical profile 16 and renders a target position.

As soon as inaccuracies occur—in the region of the front tracing point 11—as a result of residual faults after tamping, these inaccuracies are copied, as it were, in the course of the lowering of the track by the stabilizing unit. Now, the particular problems resulting therefrom lie in the fact that the rear tracing point 11 is guided along these copied vertical position faults (see solid line in FIG. 2) and thus the precision of the lowering of the track is additionally impaired.

In order to eliminate this grave disadvantage, a longitudinal inclination $\alpha$ of the track 2 is measured by means of the rear longitudinal pendulum 15 (either the left or the right longitudinal pendulum 15 of the corresponding on-track undercarriage 3, depending on the choice of reference rail) at equal spaces (preferably distances of 20 cm) and stored in the control device 14 in connection with a distance measurement by the odometer 13.

From the stored values for the longitudinal inclination $\alpha$ and the associated distance measurement, a current vertical profile 16 of the track 2 is formed for a length of track reaching back at least 10 meters from the rear tracing point 11 with regard to the working direction 6. Subsequently, the rear compensation straight line 17 is calculated which is superimposed on the vertical profile 16 and renders a target track position.

The rear tracing point 11 is guided by calculation along the virtual compensation straight line 17 so that a corresponding compensation value for the calculated position of the measuring chord 12 ensues at the middle tracing point 11. This position is relevant for determining the settlement h, i.e. the actual height of the track lowering by means of the stabilizing unit 8.

Shown in FIG. 3 is a front vertical profile 18 of the preliminary track position resulting from tamping of the track 2.

This front vertical profile 18 is known from measuring values recorded by the tamping machine and transferred to the control device 14. Should this not be the case, then the front vertical profile 18 can be traced by means of the longitudinal pendulum 15 provided at the front on-track undercarriage 3 and equidistant measurements, and stored. Reaching back over a length of at least 10 meters, a front compensation straight line 19 is formed by calculation. Along the latter, the front tracing point 11 is guided by calculation in order to thereby prevent the residual faults from having any negative influence upon the measuring system 10.

As visible in FIG. 4, a target straight line 20 extending parallel to the front compensation straight line 19 and defining the target position after operation of the stabilizing unit 8 is formed for the section a (FIG. 1) of the track 2. The difference between said target straight line 20 and the front vertical profile 18 yields the respective settlement h for the lowering the track 2. In order to realize this varying settlement h, either the frequency for the unbalanced mass of the vibration drive or the distance of the unbalanced mass relative to the axis of rotation is altered. Thus, a difference, determined at the middle tracing point 11, between the target position and the actual position of the track 2 is used as a control variable for changing the dynamic striking force.

The invention claimed is:

1. A method for the controlled lowering of a track, which comprises the following method steps:

setting the track in transverse vibrations with the aid of dynamic striking forces and loading the track with a vertical static load, and controlling a settlement defining the lowering of the track with a measuring system for tracing a track position, the measuring system having a measuring chord extending in a longitudinal direction of the machine and having tracing points configured to roll on the track and including a rear tracing point and a front tracing point, with reference to a working direction;

detecting and storing a longitudinal inclination of the track at the rear tracing point in connection with a distance measurement;

from the stored values for the longitudinal inclination and the distance measurement, forming a current vertical profile of the track for a length of track reaching back at least 10 meters from the rear tracing point with regard to the working direction, and calculating a rear compensation straight line that is superimposed upon the vertical profile and renders a target track position;

guiding the rear tracing point by calculation along the rear compensation straight line so that a compensation value for the position of the measuring chord ensues at a middle tracing point positioned between the rear tracing point and the front tracing point.

2. The method according to claim 1, which comprises:

detecting and storing a longitudinal inclination of the track at the front tracing point in connection with a distance measurement;

from the stored values for the longitudinal inclination and the distance measurement, forming a current vertical profile of the track for a length of track reaching back at least 10 meters from the front tracing point with regard to the working direction, and calculating a front compensation straight line that is superimposed upon the vertical profile and renders a target track position; and guiding the front tracing point by calculation along the front compensation straight line so that a corresponding compensation value for the position of the measuring chord ensues at the middle tracing point.

3. The method according to claim 2, which comprises using a difference, determined at the middle tracing point, between the actual position and the target position of the track, as a control variable for altering the dynamic striking force.

4. The method according to claim 1, which comprises using a difference, determined at the middle tracing point, between the actual position and the target position of the track, as a control variable for altering the dynamic striking force.

5. A machine for the controlled lowering of a track, comprising:

a stabilizing unit disposed between on-track undercarriages and configured to be form-fittingly applied to the track and producing dynamic striking forces;

a measuring system for detecting a longitudinal inclination of the track, said measuring system including a front tracing point and rear tracing point, with regard to a working direction, each designed to roll on the track, a middle tracing point positioned between the front and rear tracing points, and an odometer;

a longitudinal pendulum for detecting the longitudinal inclination of the track disposed on a rear on-track undercarriage, relative to said stabilizing unit;

a control device configured to store the longitudinal inclination and to form a current vertical profile and configured to determine, by calculation, a rear compensation straight line that is superimposed upon a current vertical profile and renders a target position.

6. The machine according to claim 5, which comprises, disposed on a front on-track undercarriage, relative to said stabilizing unit, a longitudinal pendulum for detecting the longitudinal inclination of the track, and a control device configured to store the longitudinal inclination and to form a current vertical profile and configured to calculate a front compensation straight line that is superimposed upon the current vertical profile and renders a target position.

7. The machine according to claim 5, wherein two longitudinal pendulums, spaced from one another in a transverse direction of the track, for detecting the longitudinal inclination of the track are disposed on each of said on-track undercarriages.

8. The machine according to claim 5, wherein a distance between the middle tracing point and the front tracing point of the measuring system is smaller than a distance between the middle tracing point and the rear tracing point.

* * * * *